US006165113A

United States Patent [19]

Reider

[11] Patent Number: 6,165,113

[45] Date of Patent: Dec. 26, 2000

[54] METHOD AND MECHANISM FOR SENSING THE POSITION OF THE TOP OF A STACK OF PAPER

[75] Inventor: Robert J. Reider, Longmont, Colo.

[73] Assignee: Pentax Technologies Corporation, Broomfield, Colo.

[21] Appl. No.: 09/244,075

[22] Filed: Feb. 4, 1999

[51] Int. Cl.[7] ..... B31B 1/00

[52] U.S. Cl. ..... 493/25; 493/8; 493/34; 493/18; 493/17; 493/15; 493/412; 493/411; 493/410; 493/415

[58] Field of Search ..... 493/23, 8, 34, 493/30, 25, 18, 17, 15, 412, 411, 410, 413, 414, 415; 271/215, 517; 414/925, 926, 924; 200/61.13, 61.14, 61.2

[56] References Cited

U.S. PATENT DOCUMENTS

| | | | |
|---|---|---|---|
| 3,735,975 | 5/1973 | Sukel et al. . | |
| 4,296,684 | 10/1981 | Wangermann . | |
| 4,401,021 | 8/1983 | Noll, Jr. . | |
| 4,428,574 | 1/1984 | Kataoka . | |
| 4,460,350 | 7/1984 | Mittal et al. | 493/412 |
| 4,508,527 | 4/1985 | Uno et al. | 493/357 |
| 4,718,807 | 1/1988 | Baxter . | |
| 4,723,488 | 2/1988 | Inouye et al. | 493/411 |
| 4,938,467 | 7/1990 | Honjo et al. | 493/23 |
| 5,017,972 | 5/1991 | Daughton et al. | 271/215 |
| 5,425,694 | 6/1995 | Negishi | 493/320 |
| 5,518,230 | 5/1996 | Scarlata et al. | 271/215 |
| 5,613,673 | 3/1997 | Roberts et al. | 271/215 |
| 5,616,113 | 4/1997 | Van Den Bergh | 493/415 |

*Primary Examiner*—Peter Vo
*Assistant Examiner*—Sam Tawfik
*Attorney, Agent, or Firm*—Greenblum & Bernstein P.L.C.

[57] ABSTRACT

A method and mechanism for sensing the position of the top of a stack of material in a stacking apparatus. The mechanism includes, a hub assembly, an arm, a stop, a torsion device that biases the arm toward the stop, a first trigger and a second trigger. The hub assembly has a hollow center portion configured to accept a shaft that is rotatably and driveably mounted to a stacking apparatus. The hub assembly includes a hub having a first form and a second form each mounted to a respective hub end. The arm has a first end pivotally mounted to the first form, and a second end configured to removably contact the stack of paper. The first trigger is configured to trigger a height sensor. The height sensor is mounted to the stacking apparatus, and the height sensor is configured to provide a first signal to a central processing unit to lower a collection table when the arm triggers the height sensor. The stop is mounted to the first form below the arm, the stop configured to stop the pivoting movement of the arm. The second trigger is mounted to the second hub and configured to trigger a validity sensor. The validity sensor is mounted to the stacking apparatus, and is configured to provide a second signal to the central processing unit. The second signal is configured to indicate to the central processing unit that it is appropriate to accept the first signal. A method for sensing the position of the top of a stack of material in a stacking apparatus is also provided.

20 Claims, 19 Drawing Sheets

METHOD AND MECHANISM FOR SENSING THE POSITION OF THE TOP OF A STACK OF PAPER

BACKGROUND OF THE INVENTION

1. Field of the Invention

The present invention is related to the stacking of material, and more particularly, to a method and mechanism for sensing the position of the top of a stack of paper in a paper stacking apparatus.

2. Background and Material Information

In xerographic and other copiers, scanners, printers or other document imaging systems, it is desirable to automatically deposit either normal "cut sheet" documents or a continuous computer form web document, or "fanfold paper," into a catch tray after imaging, where it is stacked on a paper collection table.

Refolding and stacking of continuous form paper is often accomplished by passive gravity fed stackers, which may take the form of a wire basket or other box shaped configuration. However, problems often arise with these types of stackers, since continuous form papers have a tendency to mis-stack or mis-fold while stacking large numbers of continuous sheets. A mis-stack is defined as any media movement in the stacker that results in a fatal printer fault (i.e., the printer halts), causes the media to overflow the stacker, or requires operator intervention. A mis-fold is defined as abnormal media handling in the stacker that allows printing and stacking to continue and does not result in paper jams, fatal printer faults, or stacker overflows.

With the advent and commonplace use of laser printers, occurrences of mis-stacks and mis-folds have been exacerbated. The heat pressure rollers that the laser printer uses to fuse the toner image onto the printer paper tend to iron out the perforations between the sheets of the continuous form paper. As a result, the paper folds lose their memory and have a tendency not to easily refold into a neat stack. As printer speeds have improved over time, the occurrences of mis-folds and mis-stacks have further increased.

To reduce the likelihood of such mis-folds and mis-stacks and increase the stacking reliability, it has become commonplace to maintain a relative constant geometry between the collection area of the stacker and the output area of the imaging device. Related art active stacking apparatuses utilize spring-type paper collection tables that must be counterbalanced. This type of apparatus is unreliable in that paper length, widths and thicknesses may vary, resulting in varied weight. The paper collection table may therefore lower too great or too small of an amount, resulting in mis-folds and mis-stacks.

U.S. Pat. No. 4,460,350, which issued to Mittal et al. on Jul. 17, 1984, and is expressly incorporated herein by reference in its entirety, discusses a continuous paper stacking device. The device of this invention includes LEDs and optical detectors that enable a paper collection tray to be lowered when light from the LEDs is blocked by a paper stack.

Other related art devices employ active stacking apparatus having paper tables that descend in accordance with a longitudinal amount of paper printed. One such device is discussed in U.S. Pat. No. 4,508,527 which issued to Uno et al. on Apr. 2, 1985. This device has several shortcomings, given that papers have varied dimensions, requiring the lowering of the paper table at differing intervals.

U.S. Pat. No. 4,718,807, which issued to Baxter on Jun. 12, 1988, discusses a signature stacking apparatus for the stacking of signatures. The signatures are fed onto the stack, which is supported by a support arm, and sprockets are rotated to move a chain to maintain the upper surface of the stack constant. As signatures are fed onto the stack, a sensor detects the rising level of the stack and effects operation of controls to cause a motor to rotate the sprockets, thereby lowering the support arm.

Copending application Ser. No. 08/907,615, which is expressly incorporated herein by reference in its entirety, describes an apparatus which actively refolds and stacks continuous form paper. The apparatus has a plurality of rotating paddles which assist in packing down paper as it is placed on a paper collection table.

Having a paper stacking apparatus that has none of the above-mentioned problems is therefore desirable.

SUMMARY OF THE INVENTION

The present invention provides a method and mechanism for sensing the position of the top of a stack of paper in a stacking apparatus. The mechanism has a first form, and an arm having a first end pivotally mounted to the first form, and a second end configured to contact the stack of paper removably. The arm additionally has a first trigger configured to trigger a paper height sensor. The paper height sensor is mounted to the stacking apparatus and is configured to provide a first signal to a central processing unit to lower a paper collection table when the arm triggers the paper height sensor. A stop configured to stop the pivoting movement of the arm, as well as a torsion device configured to bias the arm toward the stop.

The first form may be rotatably and driveably mounted to the stacking apparatus. Additionally, the stop may be either mounted to the first form at a position below the arm, or alternatively, may be mounted directly to the arm.

According to another feature of the invention a second trigger may be mounted to the first hub and configured to trigger a validity sensor, the validity sensor mounted to the stacking apparatus, the validity sensor configured to provide a second signal to the central processing unit, the second signal configured to indicate to the central processing unit that it is appropriate to accept the first signal.

The invention further may feature a second form mounted parallel to the first form and connected thereto by a hub, and may further feature a second trigger mounted to the second hub, the second trigger configured to trigger a validity sensor. The validity sensor is mounted to the stacking apparatus and is configured to provide a second signal to the central processing unit, the second signal being configured to indicate to the central processing unit that it is appropriate to accept the first signal.

Additionally, either or both of the first and second forms may be embodied as discs.

Furthermore, the first form, the second form and the hub may be fixedly mounted about a shaft, the shaft being rotatably and driveably connected to the stacking apparatus. The shaft may further be rotatably driven by a drive mechanism without use of a shaft.

A method for sensing the position of stack of paper in a stacking apparatus may comprise triggering a sensor to provide a first signal to the central processing unit, the signal instructing the central processing unit to lower the paper collection table, and providing a second signal to the central processing unit, the second signal indicating to the central processing unit that it is appropriate to accept the first signal. The method may further comprise lowering the paper collection table.

Another method for sensing the position of a stack of paper in a stacking apparatus may comprise rotating a form fixedly mounted about a rotatable shaft, removably positioning an arm in contact with the stack of paper, triggering a paper height sensor with the trigger portion of the arm, when the stack of paper reaches a predetermined height. A first signal is provided to the central processing unit to lower the paper collection table when the trigger portion of the arm triggers the paper height sensor, and the pivoting motion of the arm is stopped.

The rotating of a form fixedly mounted about a rotatable shaft may additionally comprise rotating a hub assembly about a rotatable shaft, the hub assembly having a hollow center portion for fixedly mounting the hub about the rotatable shaft.

Additionally, a validity sensor may be triggered by a second trigger mounted to the hub, and a second signal may be provided to the central processing unit, the second signal indicating to the central processing unit that it is appropriate to accept the first signal.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE EMBODIMENT

Figure 1:
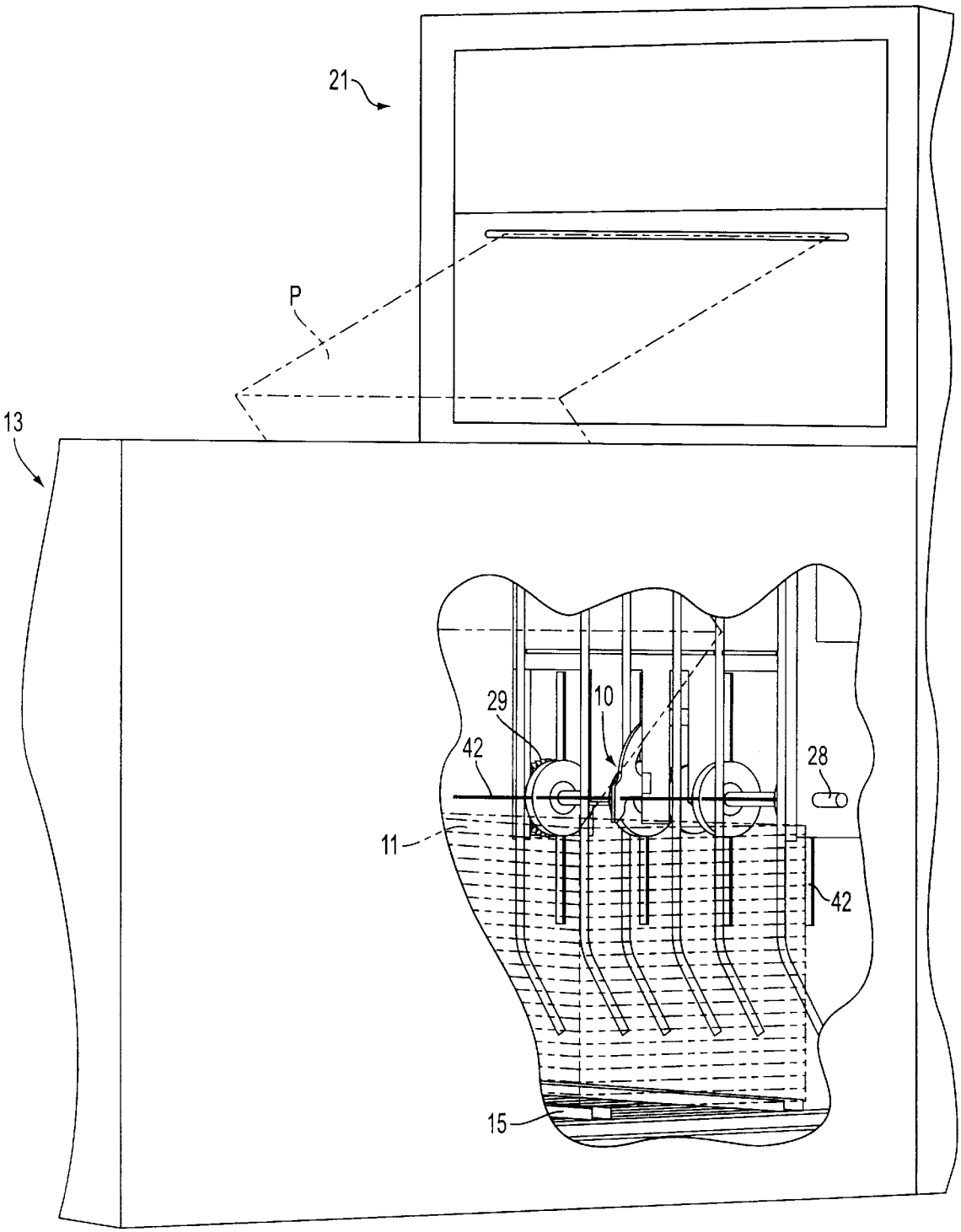
FIG. 1 is a perspective view of a mechanism for sensing the position of the top of a stack of paper in a paper stacking apparatus according to the present invention, mounted in a paper stacking apparatus.

The particulars shown herein are by way of example and for purposes of illustrative discussion of the embodiment of the present invention only and are presented in the cause of providing what is believed to be the most useful and readily understood description of the principles and conceptual aspects of the present invention. In this regard, structural details of the present invention are solely shown in detail necessary for the fundamental understanding of the present invention, the description taken with the drawings making apparent to those skilled in the art how the several forms of the present invention may be embodied in practice.

Referring now to the drawings wherein like numerals represent like elements, FIGS. 1 to 20 show a mechanism 10 for sensing the position of the top of a stack of paper 11 in a stacking apparatus 13 according to the present invention. Once the stack of paper 11 reaches a predetermined height, the mechanism 10 causes a paper collection table 15 to be lowered. The mechanism 10 is especially useful in conjunction with a printer 21 that prints on fanfold paper, but may also be used with devices that are not printers, as well as with other types of paper or other articles. The mechanism comprises a hub assembly 12, an arm 14, a stop 16, a cylindrical rod 17 and a torsion spring 18. The hub assembly 12 comprises a first form 20 and a second form 22 that are connected on either side of a hub 24. The embodiment as illustrated shows the forms 20, 22 as circular discs and this specification refers to such as discs, but in alternative embodiments the discs may be any type of form, including but not limited to squares, triangles, wedges and the like.

Figure 2:
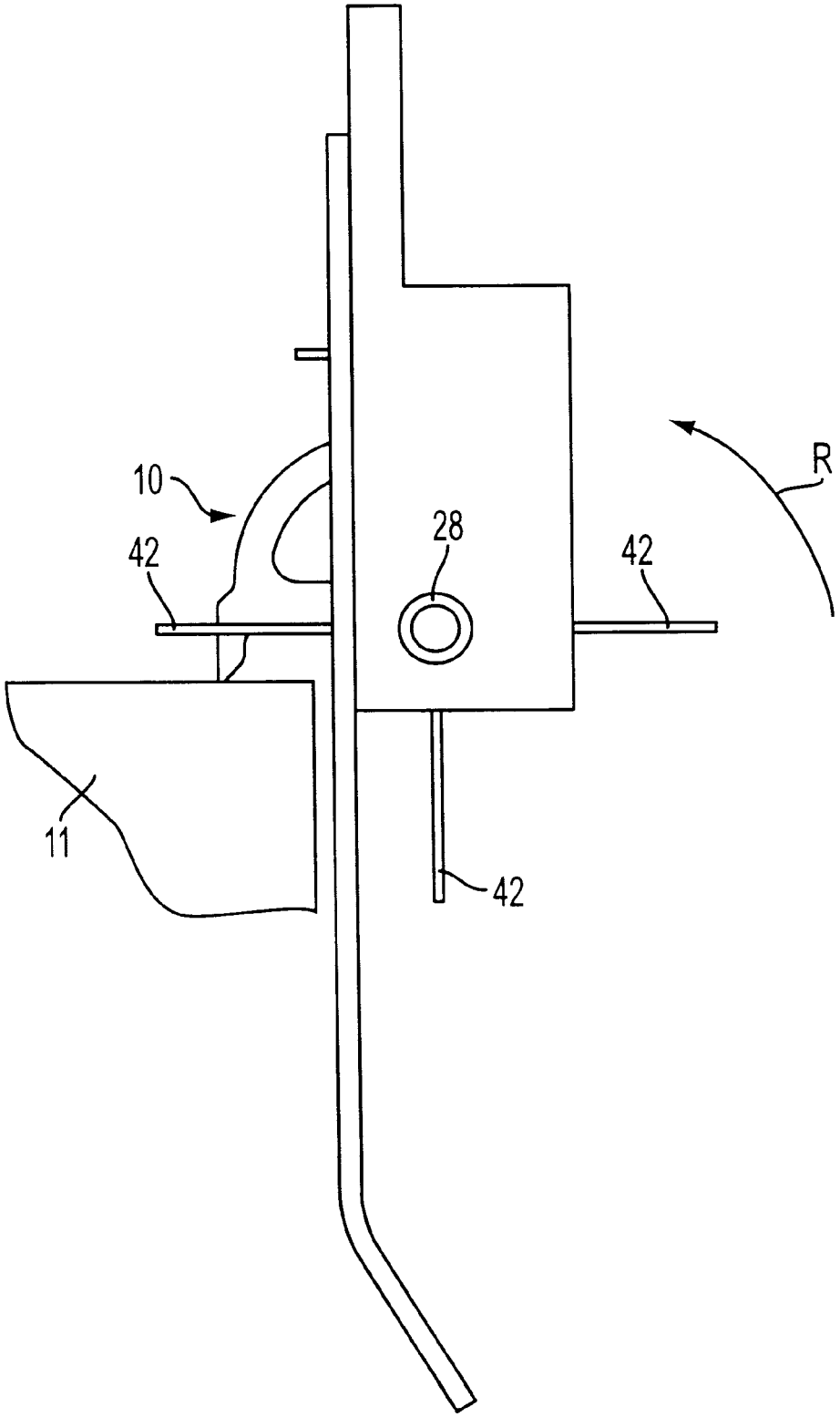
FIG. 2 is a side elevational view of a mounted mechanism of the present invention.
Figure 3:
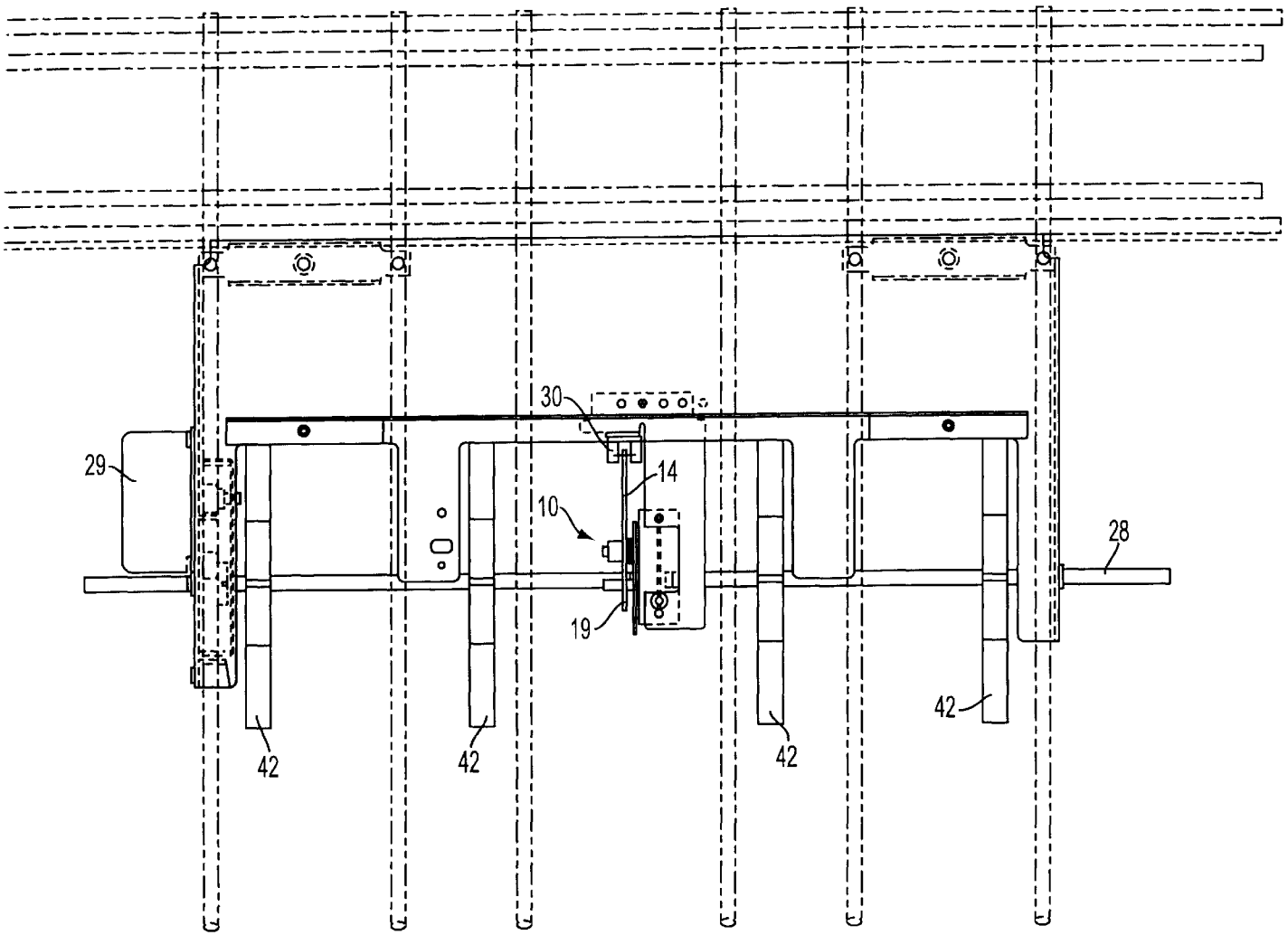
FIG. 3 is a front elevational view of the mechanism of the present invention mounted in a paper stacking apparatus.
Figure 5:
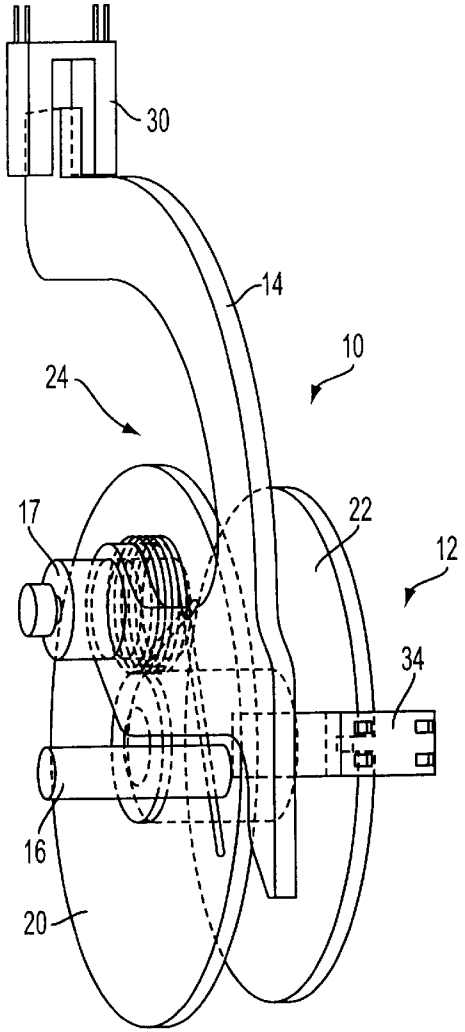
FIG. 5 is a perspective view of the mechanism of the present invention, with certain details shown in phantom lines.
Figure 4:
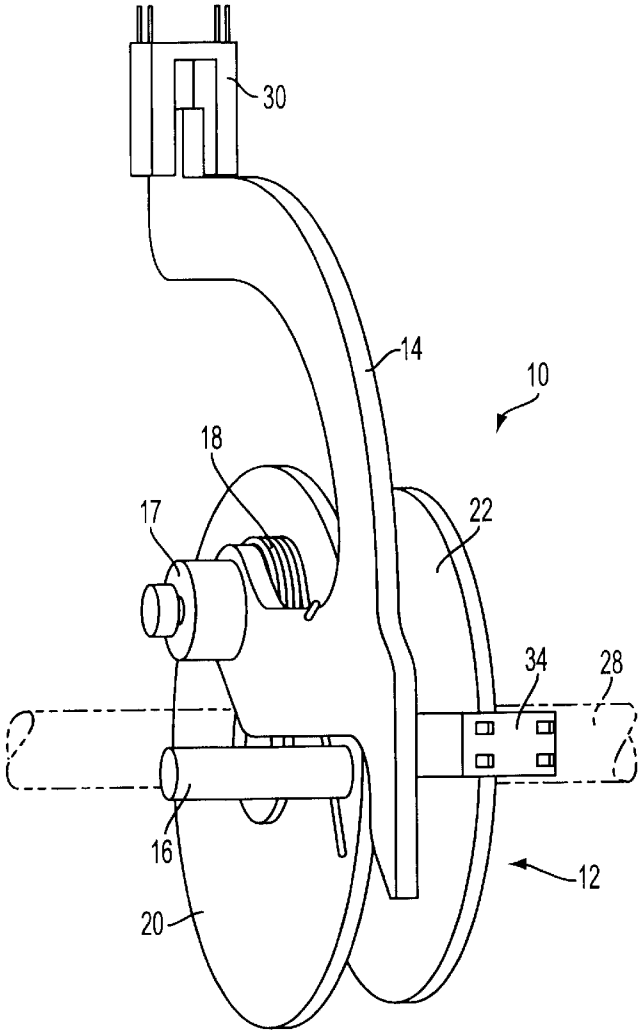
FIG. 4 is a perspective view of the mechanism of the present invention, mounted to a shaft.
Figure 6:
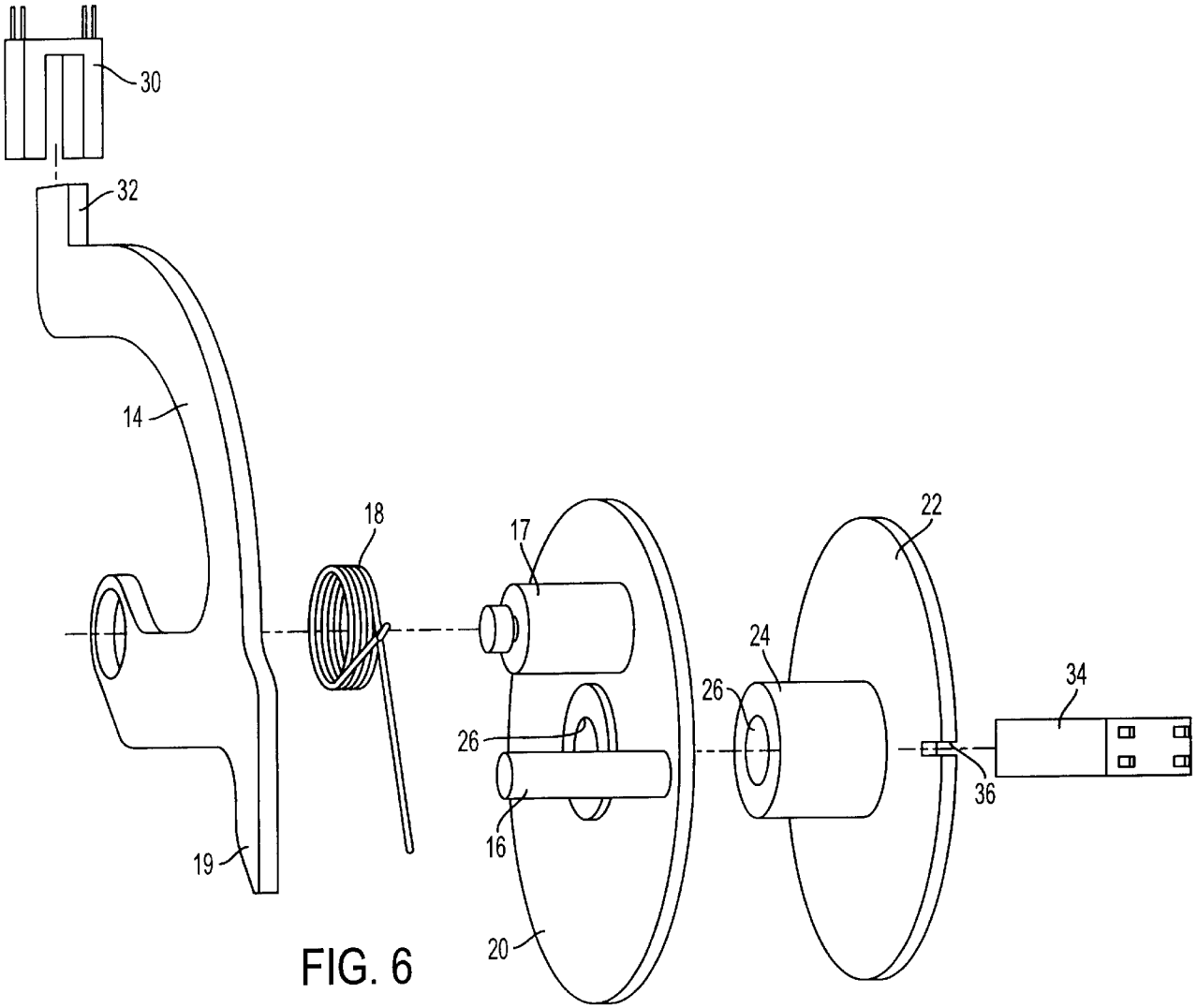
FIG. 6 is an exploded perspective view of the mechanism of the present invention.
Figure 7:
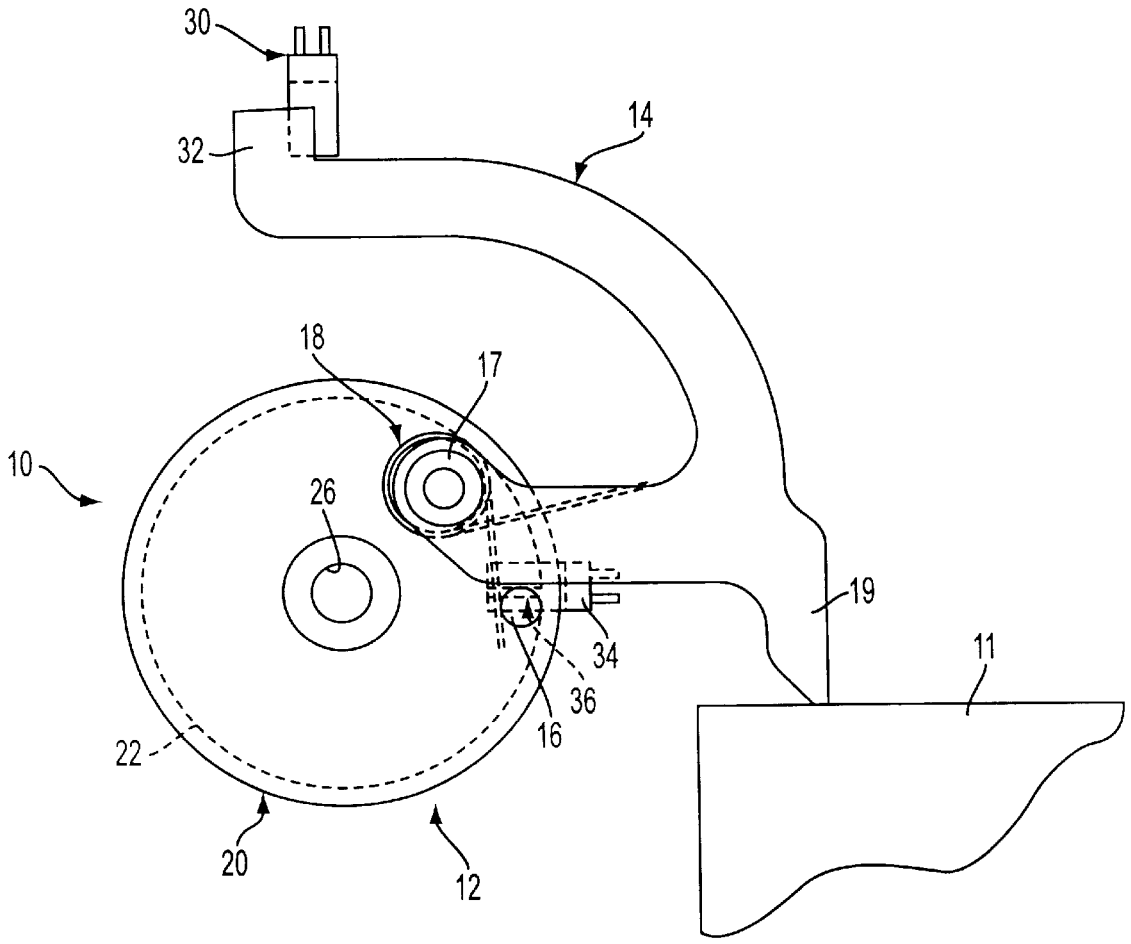
FIG. 7 is a right side elevational view of the mechanism of the present invention.

The hub assembly 12 has a hollow center portion 26 that is configured to accept a shaft 28 (shown in FIGS. 3, 4 and 6). The shaft 28 is driveably connected to a drive mechanism 29 which is in turn mounted to the stacking apparatus 13, as shown in FIGS. 1–3. The drive mechanism 29 is known in the art and is thus schematically shown. The hub assembly 12 is fixedly mounted to the shaft 28. Thus, when the shaft 28 rotates, the hub assembly 12 rotates as well. In alternative embodiments, however, the hub assembly 12 may be directly driveably mounted to the drive mechanism 29 without the need of a shaft.

Figure 8:
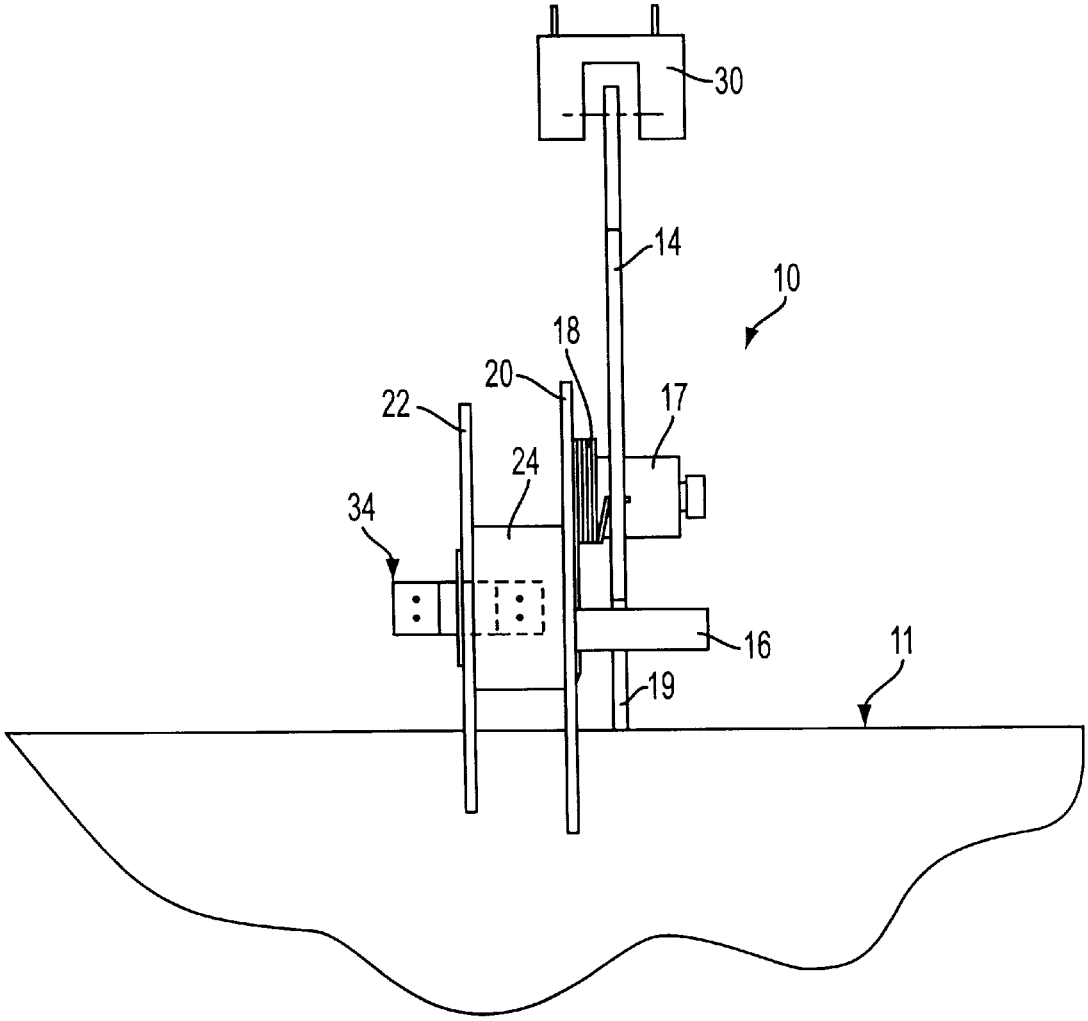
FIG. 8 is a rear elevational view of the mechanism of the present invention.
Figure 9:
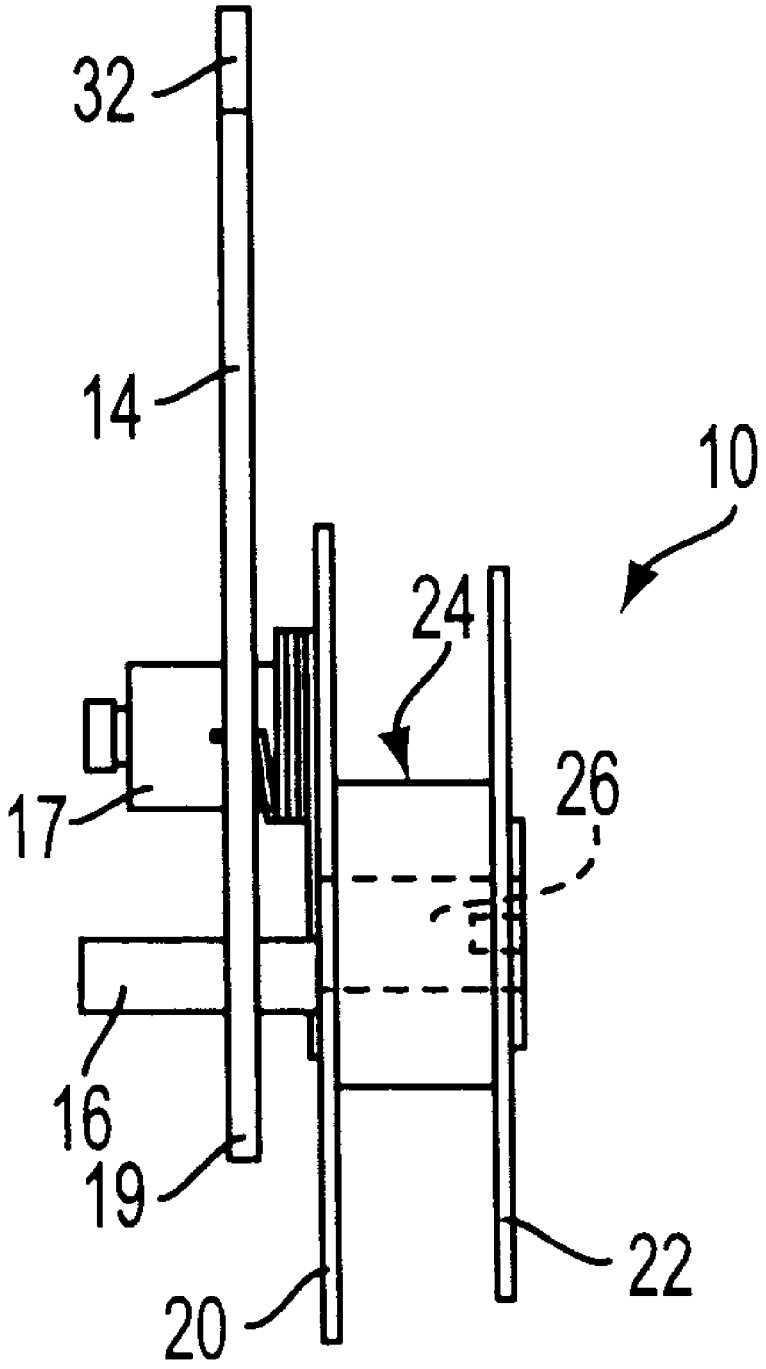
FIG. 9 is a front elevational view of the mechanism of the present invention.

The rod 17 is fixedly mounted in a generally perpendicular position to the first disc 20, as shown in FIG. 8. The arm 14 is pivotally mounted about the rod at a first end portion of the arm. The torsion spring 18 has two ends and is coiled about the rod 17, one end being affixed to the first disc 20, the other end being affixed to the arm 14. Although the figures show a coil spring in the embodiment, it is readily appreciable by those skilled in the art that other types of springs or biasing mechanisms may be used in alternative embodiments. The torsion spring 18 biases the arm 14 towards the stop 16, in a clockwise direction, best seen in FIG. 7. The range of pivoting motion of the arm 14 is limited by the stop 16, which, in the embodiment shown, is mounted to the first disc 20, although in alternative embodiments the stop may be mounted directly to the arm. The arm 14 has a finger 19 at a second end thereof that is configured to removably contact the stack of paper 11.

The mechanism 10 further comprises a paper height sensor 30 fixedly mounted to the stacking apparatus 13, as shown in FIG. 3. The arm 14 has a first trigger portion 32 configured to trigger the paper height sensor 30. The mechanism 10 additionally comprises a validity sensor 34 fixedly mounted to the stacking apparatus 13. The second disc 22 has a second trigger portion 36 (also referred to as a "sensing window") configured to trigger the validity sensor 34, best shown in FIG. 6. In the present invention, the paper height sensor 30 is embodied as an optical sensor, and the first trigger portion 32 is embodied as a tab. Also, in the present invention, the validity sensor 34 is embodied as an optical sensor, and the second trigger portion 36 is embodied as a rectangular opening present in the second disc 22. It is readily appreciable by those skilled in the art, however, that other sensors 30, 34 and other trigger portions 32, 36 may be used in alternative embodiments.

Figure 12:
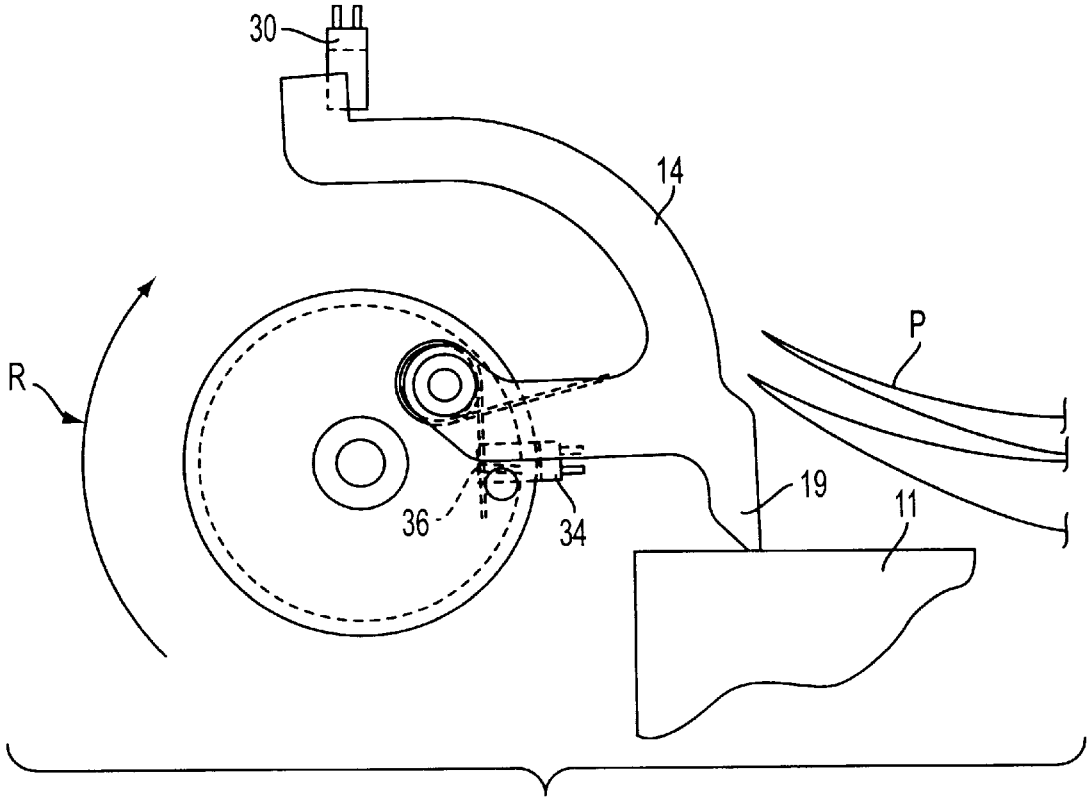
FIG. 12 is a right side elevational view of the mechanism of the present invention in an initial sensing position (i.e., a first rotational position)

A rotational cycle of the mechanism 10 will now be described. The mechanism 10 in FIG. 12 is shown in an initial sensing position (i.e., a first rotational position). In the sensing position the hub assembly 12 is positioned such that the sensing window 36 allows a light beam (which may be any form of energy) of the validity sensor to pass through the sensing window. When the light beam passes through the sensing window 36, a CPU 38 determines that a signal from the paper height sensor 30 is valid. As CPUs are well known in the art, the CPU 38 of the present invention is indicated schematically in FIG. 19. During the operation of the mechanism 10 in a stacking operation, the drive mechanism 29 causes the shaft 28, and thus the hub assembly, to rotate in a direction indicated by arrow R. Additionally, during the printing process, paper P is allowed to accumulate over the finger 19 while the finger is in contact with the stack of paper 11.

Figure 13:
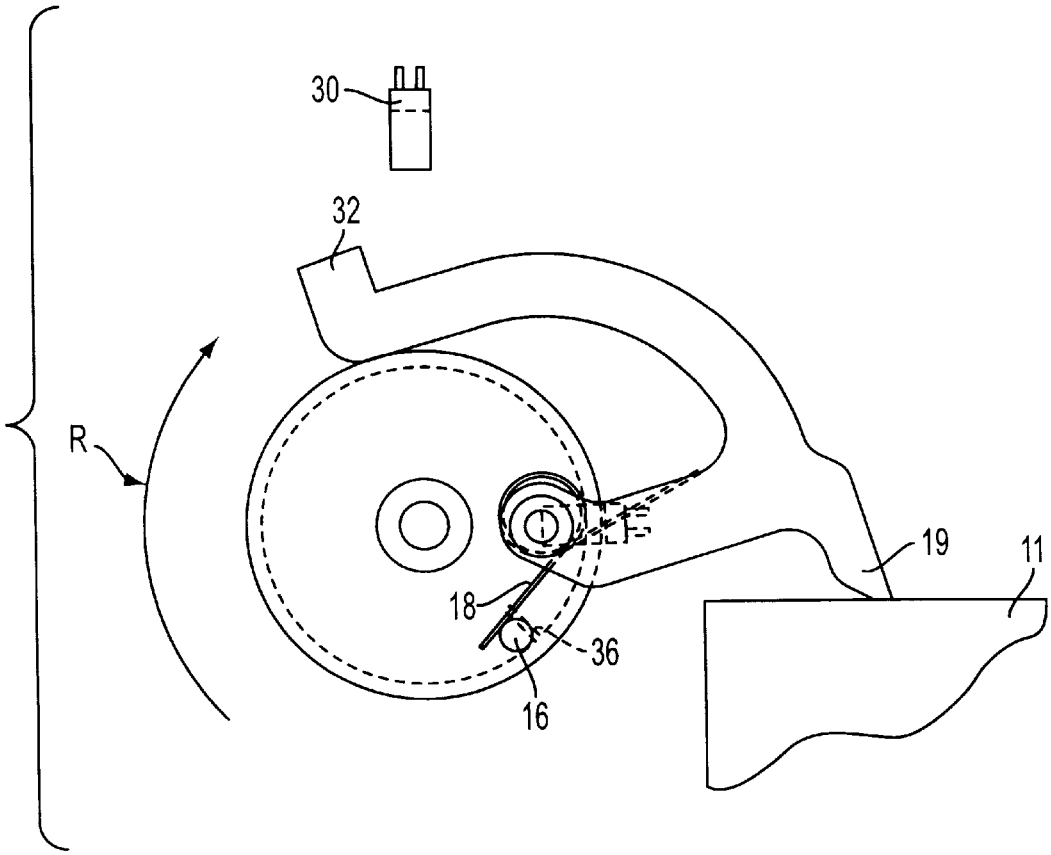
FIG. 13 is a right side elevational view of the mechanism of the present invention in a second rotational position.
Figure 14:
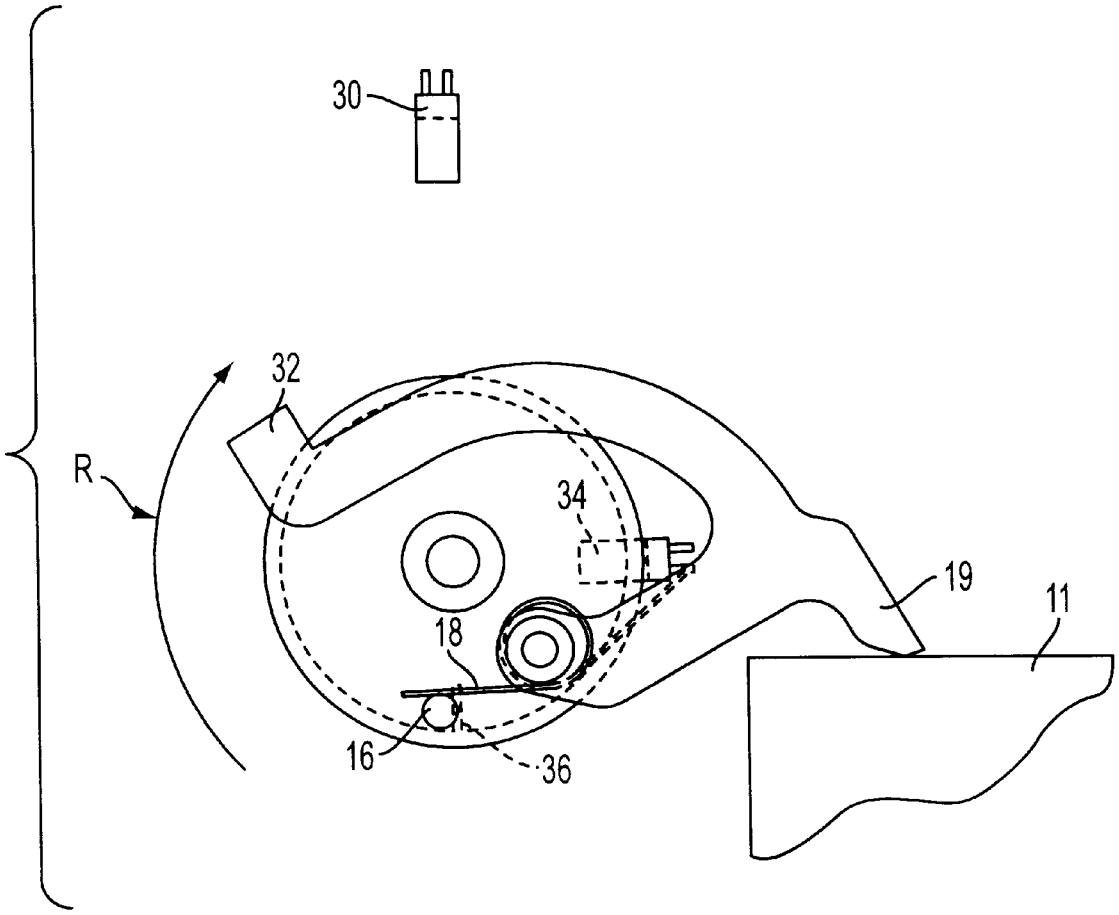
FIG. 14 is a right side elevational view of the mechanism of the present invention in a third rotational position.
Figure 15:
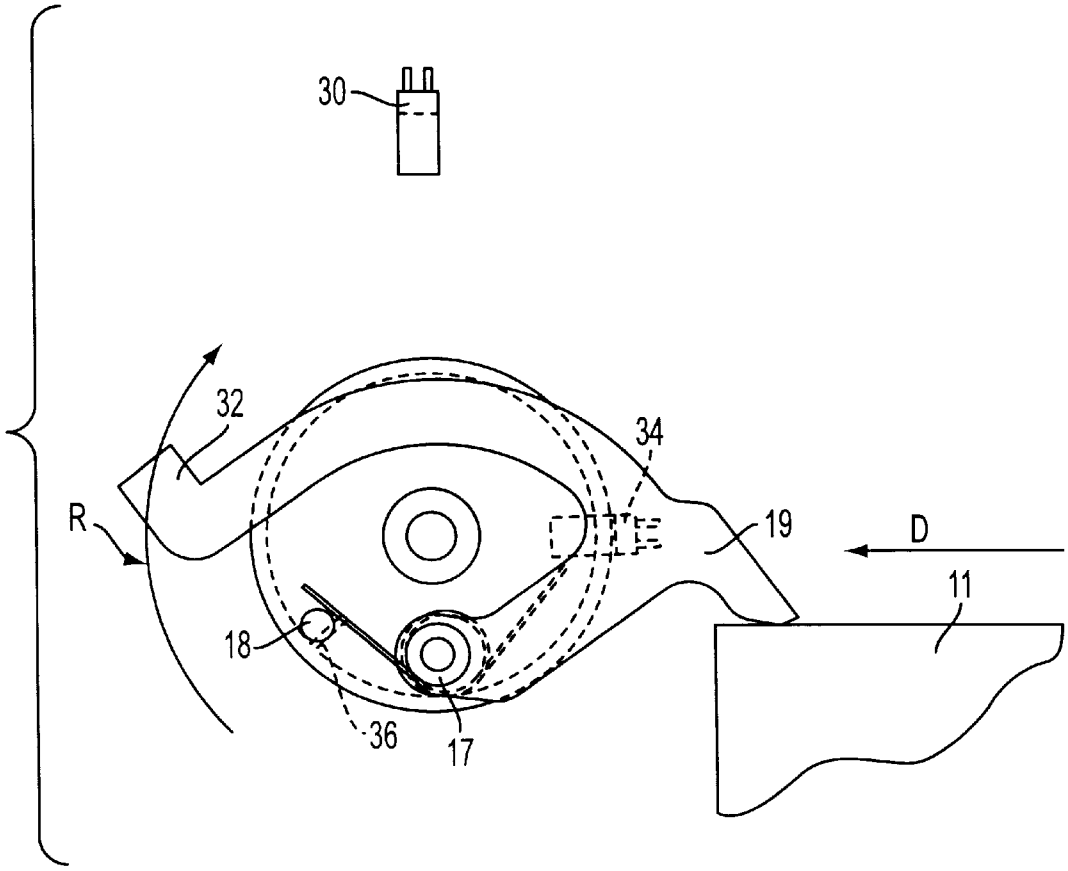
FIG. 15 is a right side elevational view of the mechanism of the present invention in a fourth rotational position.
Figure 16:
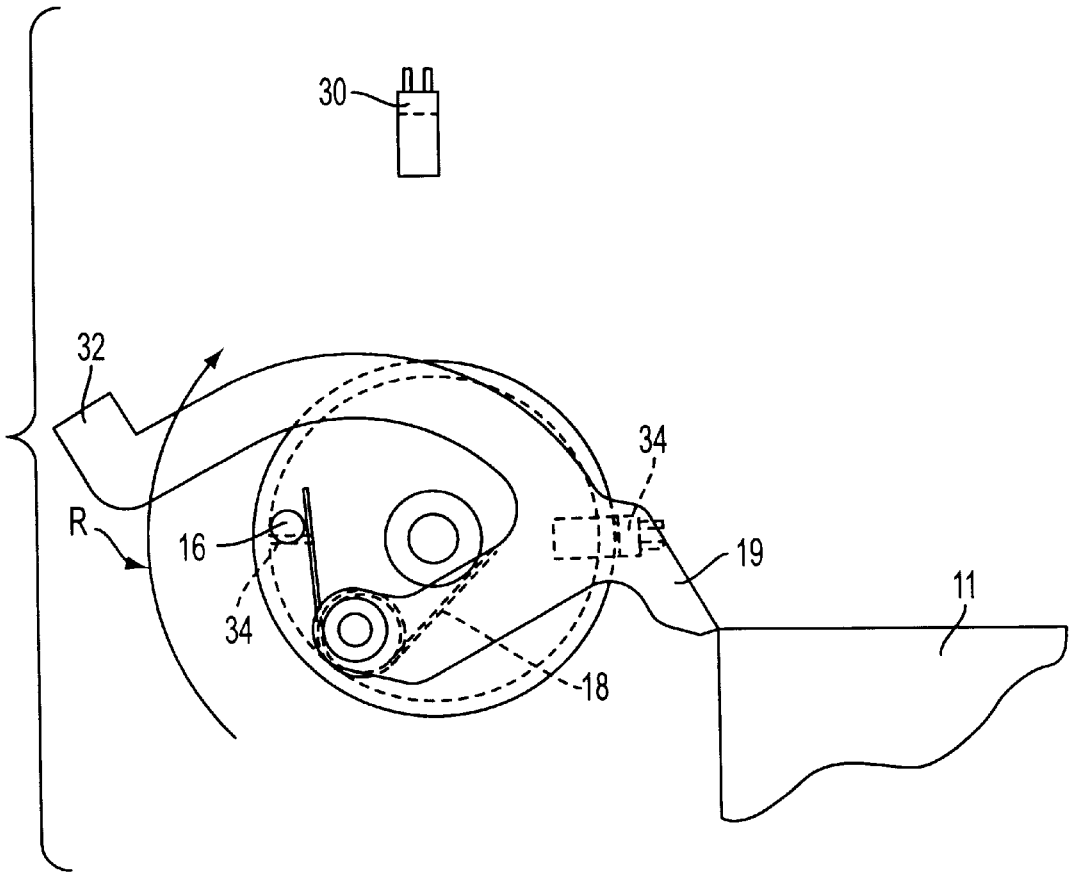
FIG. 16 is a right side elevational view of the mechanism of the present invention in a fifth rotational position.

Referring to FIG. 13, the mechanism 10 is shown in a second rotational position. As the hub assembly 12 rotates, the sensing window 36 moves away from the validity sensor 34, whereupon the CPU determines that the signal from the paper height sensor is invalid (i.e., the second disc 22 blocks the passage of the light beam). Tension is also increased in the spring 18. FIG. 14, shows the mechanism in a third rotational position, whereupon the sensing window 36 rotates further away from the validity sensor 34 and tension is further increased in the spring 18. At a fourth rotational position, shown in FIG. 15, the sensing window 36 rotates still further away from the validity sensor 34, and tension is still further increased in the spring 18. Additionally, the rod 17 pulls the finger 19 in direction of arrow D along the stack of paper. FIG. 16, shows the mechanism at a fifth rotational position, which is the point where the finger 19 drops off of the stack of paper (the sensing window 36 being at a position of approximately 178 degrees of rotation from the validity sensor 34).

Figure 17:
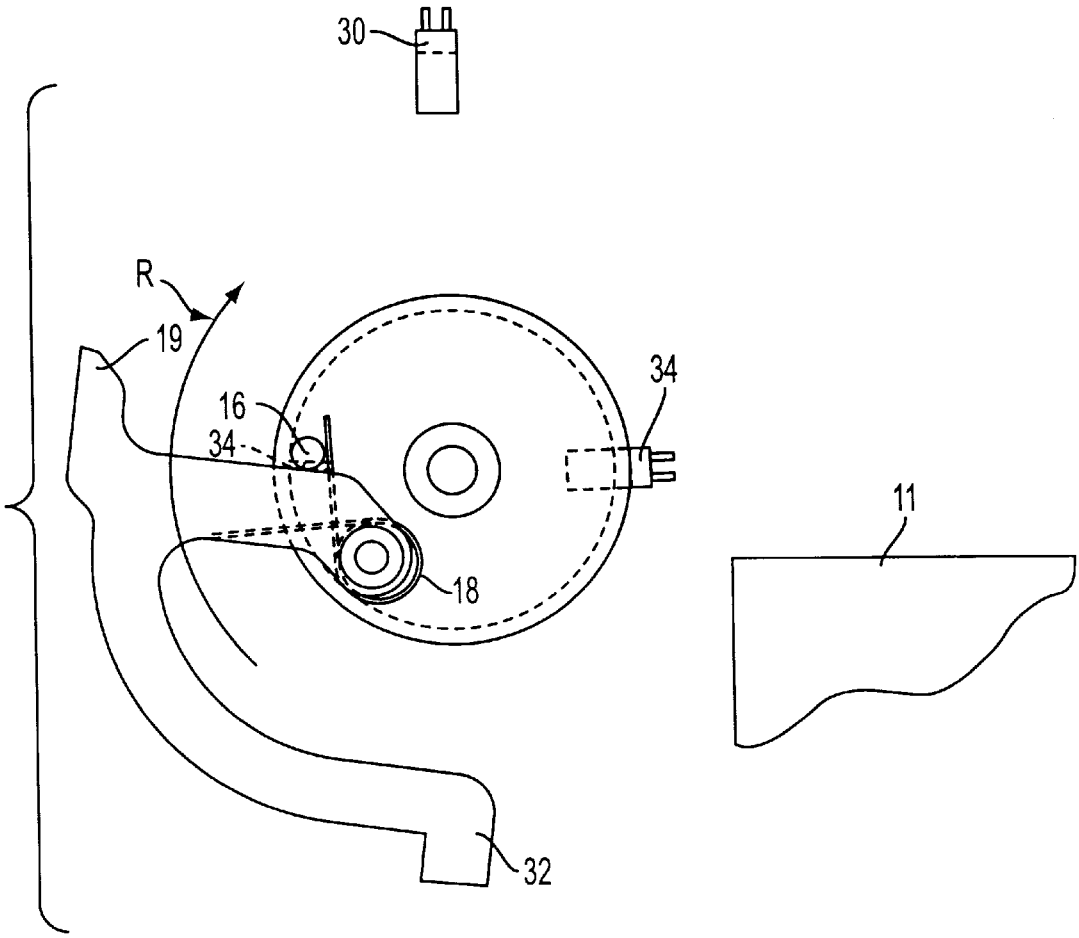
FIG. 17 is a right side elevational view of the mechanism of the present invention in a sixth rotational position.

Referring to FIG. 17, after the finger 19 drops off the stack of paper 11 at a sixth rotational position, the spring 18 causes the arm 14 to pivot about the cylindrical rod 17. The arm 19 ceases its pivoting action when the arm reaches the stop 16. Additionally, paper P that has accumulated over the finger falls to the stack of paper due to gravity, thereby increasing the height of the stack of paper. The paper P may be assisted into integrating into the stack of paper 11 by a series of paddles 42, which may be mounted on the shaft 28 and which pack down the stack, shown in FIGS. 1–3. The height of the stack of paper 11 is thus increased after every revolution of the hub assembly 12.

Figure 18:
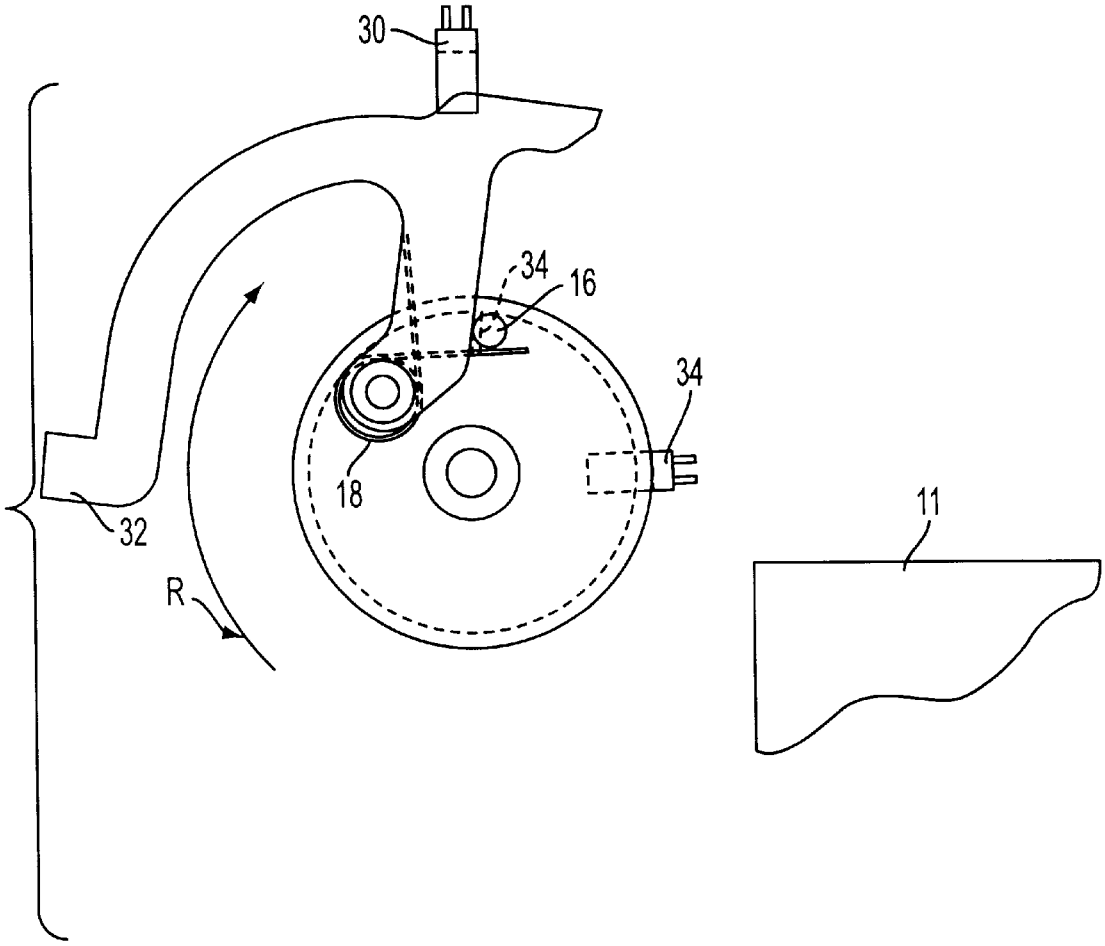
FIG. 18 is a right side elevational view of the mechanism of the present invention in a seventh rotational position.
Figure 19:
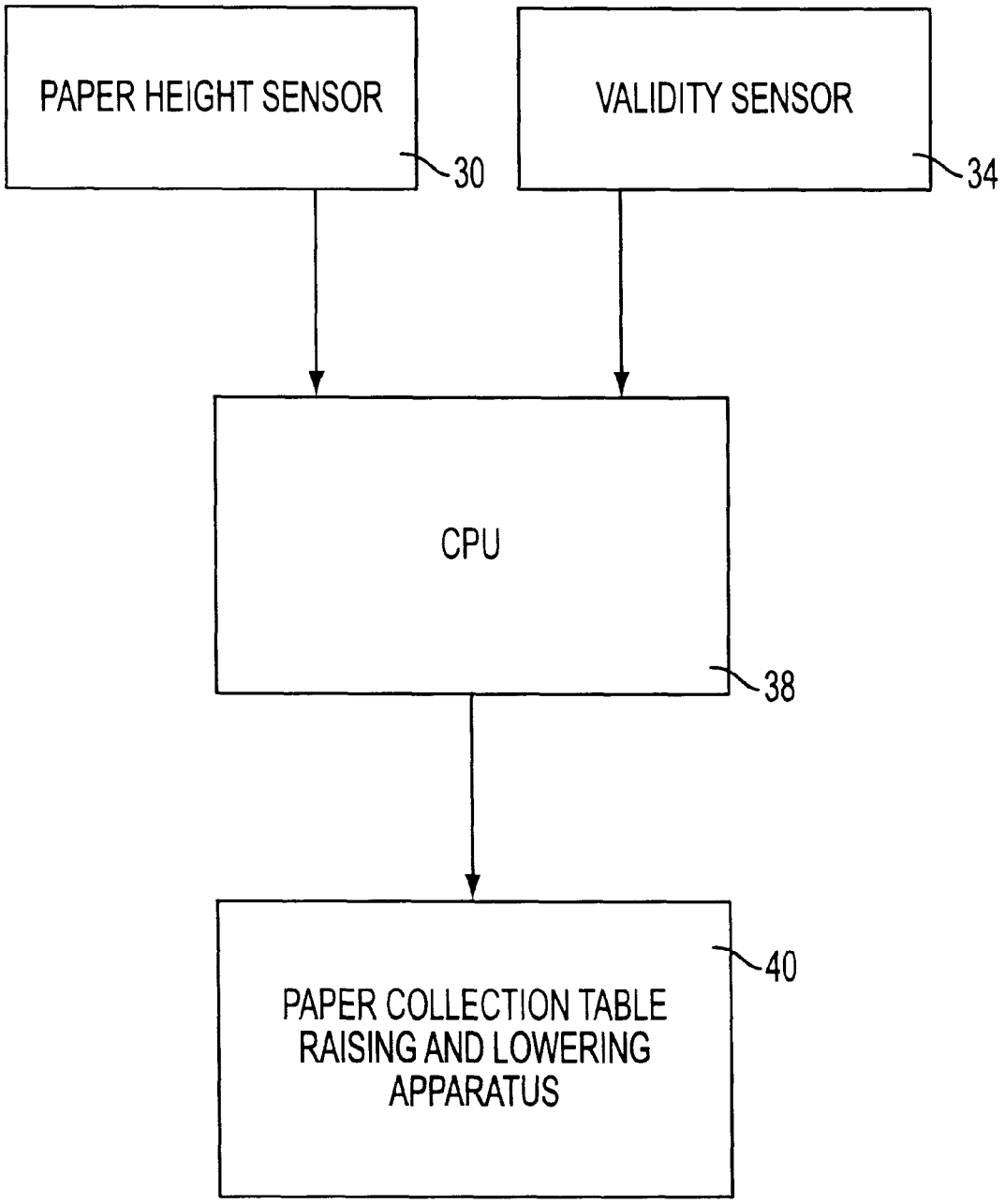
FIG. 19 is a block diagram showing the arrangement of a CPU, paper height sensor, validity sensor and paper collection table raising and lowering apparatus, according to the present invention.

FIG. 18 shows the mechanism 10 at a seventh rotational position after the sensing window 36 is at a position of approximately 270 degrees of rotation from the validity sensor 34, whereupon the finger 19 begins to approach the stack of paper 11. After a complete revolution, the mechanism 10 is returned to the initial sensing position (i.e., the first rotational position), as shown in FIG. 12, whereupon the signal from the paper height sensor 30 is considered valid by the CPU 38. Thus, in the second-seventh rotational positions, the paper height sensor 30 is considered invalid by the CPU 38.

Figure 10:
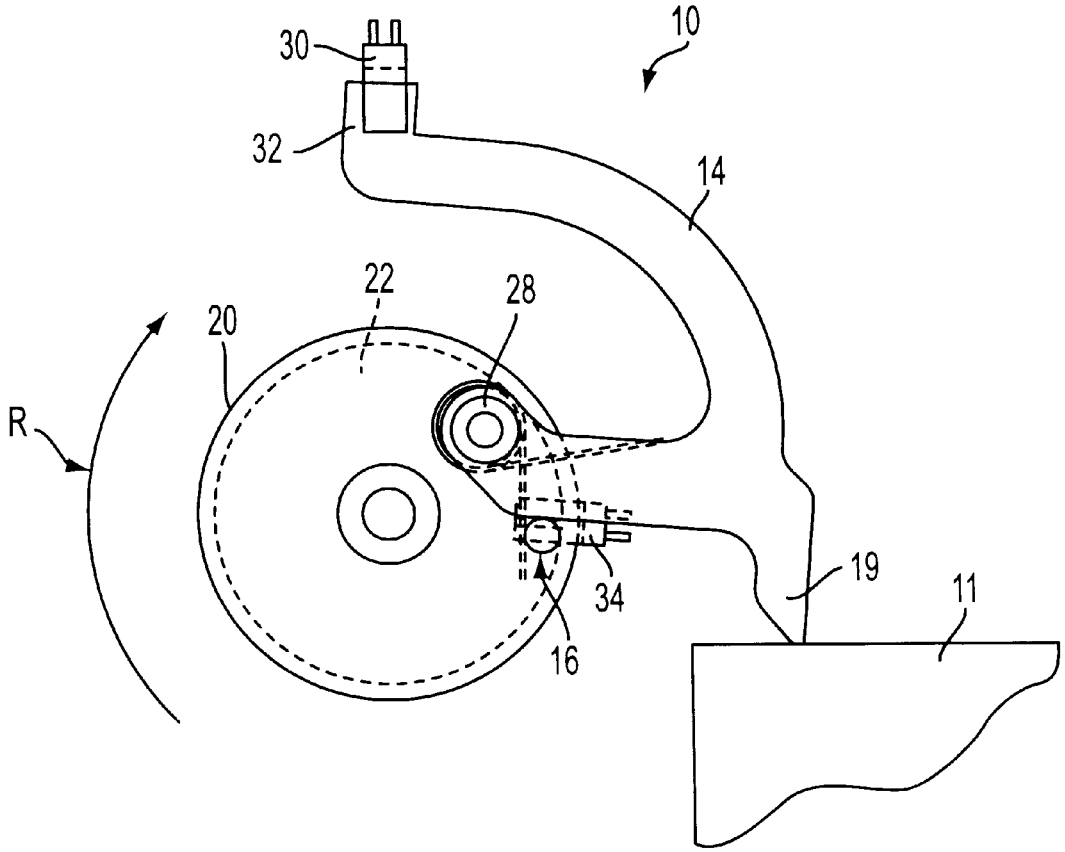
FIG. 10 is a right side elevational view of the mechanism of the present invention , showing a paper stack in a low position.
Figure 11:
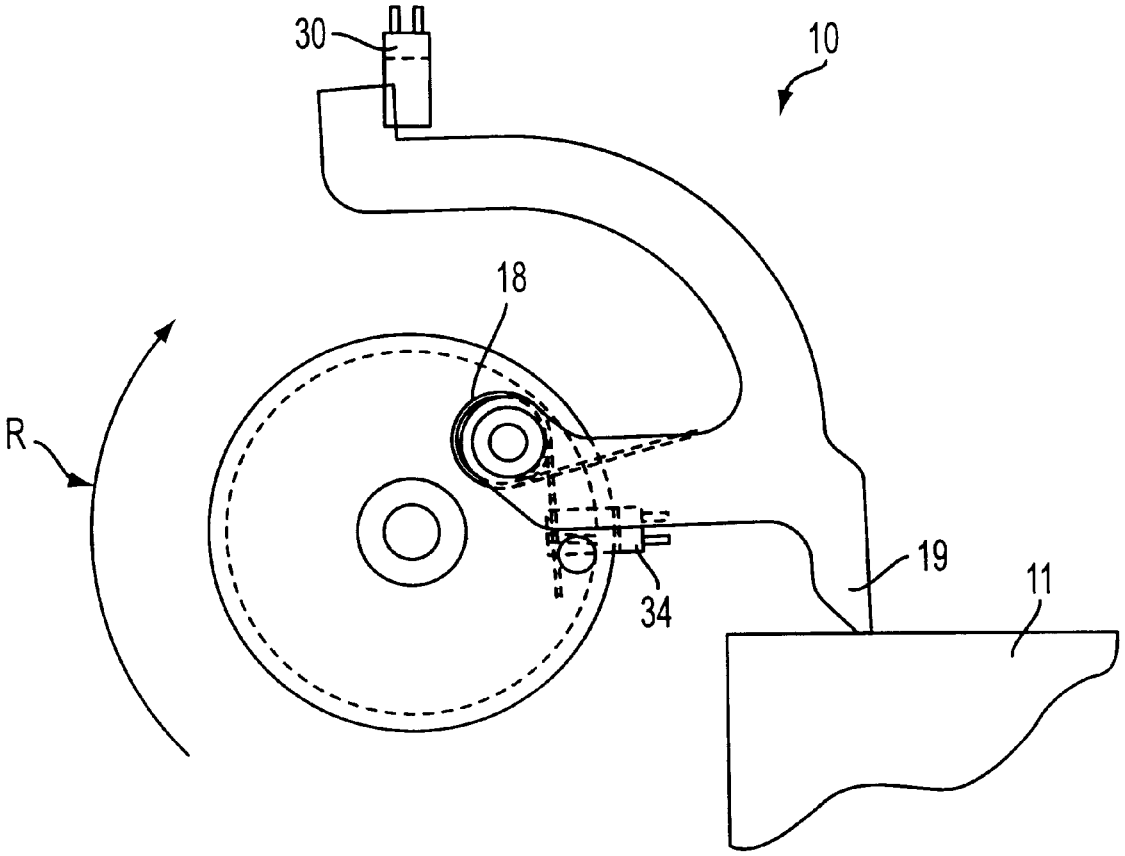
FIG. 11 is a right side elevational view of the mechanism of the present invention, showing a paper stack in a high position.

After each complete revolution of the hub assembly 12, the CPU 38 reads the signal of the paper height sensor 30, when the hub assembly is at the initial sensing position. FIG. 10 shows the mechanism 10 when the height of the stack of paper 11 is low, and FIG. 11 shows the shows the mechanism 10 when the height of the stack of paper is high. When the height of the stack of paper 11 is low, the arm 14 is oriented so that the trigger portion 32 passes through the light beam paper height sensor 30, thereby blocking the passage of the light beam from one side of the sensor to another, as shown best in FIGS. 4, 5, 7 and 8. Since the height of the stack of paper 11 is increased after every revolution of the hub assembly 12 (unless the paper collection table is lowered), the arm 14 is slightly pivoted in a different position, against the direction of arrow R after every revolution of the hub assembly. Thus, each time the finger 19 comes into contact with the stack of paper 11 (i.e., after every revolution of the hub assembly 12), the trigger is moved slightly to the left of the paper height sensor 30, as shown in FIG. 11 (unless the paper collection table is lowered). Accordingly, each time the finger 19 comes into contact with the stack of paper 11, the CPU 38 samples the height of the stack of paper and determines whether or not to lower the paper collection table 15.

Once the stack of paper 11 reaches a specified height, the trigger portion 32 is moved out of the path of the light beam of the paper height sensor 30, and no longer blocks the passage of light from one side of the paper height sensor 30 to another, thereby triggering the paper height sensor. Once the triggering of the paper height sensor 30 is acknowledged by the CPU 38, the CPU instructs a paper collection table raising/lowering apparatus 40 to lower the paper collection table. Since paper collection table raising/lowering apparatus are known in the art, the paper collection table raising/lowering apparatus 40 of the present invention is shown schematically in FIG. 19. The paper height sensor 30 of the present invention is shown embodied as an optical sensor, and it triggered when the trigger portion 32 is moved out of the path of the light beam of the paper height sensor 30, and no longer blocks the passage of light from one side of the paper height sensor 30 to another. However, it will be readily appreciable by those skilled in the art that other sensors may be used and differently triggered, including but not limited to triggering a sensor by moving a trigger into the path of a light beam of a sensor, thus blocking the passage of light from one side of the sensor to another.

Once the paper collection table 15 is lowered, the arm 14 is reoriented so that the trigger portion 32 again passes through the light beam paper height sensor 30, and the shaft 28 and hub assembly 12 continue to rotate until the paper height sensor is triggered again and the paper collection table is again lowered. This cycle can repeat indefinitely until the paper collection table 15 reaches the bottom of the stacking apparatus 13 and can no longer be lowered.

Figure 20:
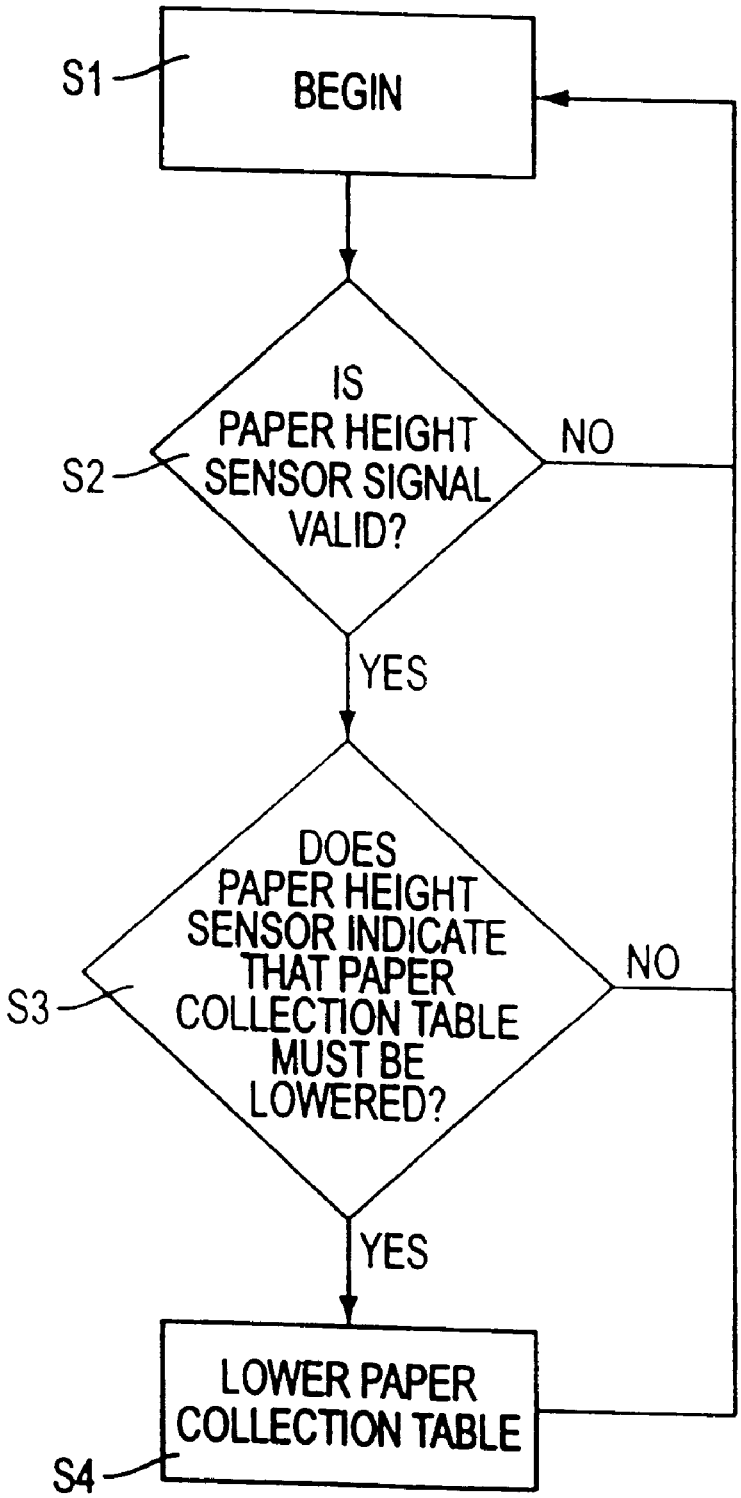
FIG. 20 is a flowchart showing the flow of software logic according to the present invention.

Referring to FIG. 20, the method of operation of software employed by the invention will now be described. At step S1, the software is initialized at a "begin" procedure. At step S2, the CPU 38 checks if the validity sensor 34 signal is valid. If the validity sensor 34 signal is not valid, the software directs the CPU 38 back to step S1, where it is directed to check again if the validity sensor 34 signal is valid. Once the CPU determines that the validity sensor 34 signal is valid, the software proceeds to step S3. At step S3, the CPU 38 is instructed to check if the paper height sensor has been triggered (i.e., whether the paper height sensor indicates that the paper collection table 15 must be lowered). If the paper height sensor 30 has not been triggered, the software directs the CPU 38 back to step S1, where it is directed to check again if the validity sensor 34 signal is valid. If the paper height sensor 30 has been triggered, at step S4, the software directs the CPU 38 to activate the paper collection table raising/lowering apparatus 40, thereby lowering the paper collection table 15. Once the paper collection table 15 has been lowered, the software directs the CPU 38 back to step S1, where it is directed to check again if the validity sensor 34 signal is valid.

It is noted that the foregoing examples have been provided merely for the purpose of explanation and are in no way to be construed as limiting of the present invention. While the present invention has been described with reference to a certain embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A mechanism for sensing a position of a top of a stack of material in a stacking apparatus, the apparatus having a collection table and a central processing unit, the mechanism comprising:

a first form;

an arm having a first end pivotally mounted to said first form, and a second end configured to removably contact the stack of material, said arm further having a first trigger configured to trigger a height sensor; said height sensor mounted to the stacking apparatus, said height sensor configured to provide a first signal to the central processing unit to lower the collection table when said arm triggers said height sensor;

a stop configured to stop pivoting movement of said arm; and a torsion device configured to bias said arm toward said stop.

2. The mechanism for sensing a position of a top of a stack of material in a stacking apparatus according to claim 1, said first form being rotatably and driveably mounted to the stacking apparatus.

3. The mechanism for sensing a position of a top of a stack of material in a stacking apparatus according to claim 1, said stop mounted to said first form below said arm.

4. The mechanism for sensing a position of a top of a stack of material in a stacking apparatus according to claim 1, said stop mounted to said arm.

5. The mechanism for sensing a position of a top of a stack of material in a stacking apparatus according to claim 1, further comprising a second trigger mounted to said first form and configured to trigger a validity sensor, said validity sensor mounted to the stacking apparatus, said validity sensor configured to provide a second signal to the central processing unit, said second signal configured to indicate to the central processing unit that the central processing unit may accept said first signal.

6. The mechanism for sensing a position of a top of a stack of material in a stacking apparatus according to claim 1, wherein said first form is a disc.

7. The mechanism for sensing a position of a top of a stack of material in a stacking apparatus according to claim 1, further comprising:

a second form mounted parallel to said first form and connected thereto by a hub; and a second trigger mounted to said second [hub] form and configured to trigger a validity sensor, said validity sensor mounted to the stacking apparatus, said validity sensor configured to provide a second signal to the central processing unit, said second signal configured to indicate to the central processing unit that the central processing unit may accept said first signal.

8. The mechanism for sensing a position of a top of a stack of material in a stacking apparatus according to claim 7, wherein second form is a disc.

9. The mechanism for sensing a position of a top of a stack of material in a stacking apparatus according to claim 7, said first form, said second form and said hub being fixedly mounted about a shaft, the shaft being rotatably and driveably connected to the stacking apparatus.

10. The mechanism for sensing a position of a top of a stack of material in a stacking apparatus according to claim 9, said shaft being rotatably driven by a drive mechanism.

11. The mechanism for sensing a position of a top of a stack of material in a stacking apparatus according to claim 1, wherein the stacking apparatus is configured to accept continuous fanfold paper.

12. A mechanism for sensing a position of a top of a stack of material in a stacking apparatus, the apparatus having a collection table and a central processing unit, the mechanism comprising:

a) a hub assembly having a hollow center portion configured to accept a shaft, the shaft being rotatably and driveably mounted to the stacking apparatus, said hub assembly comprising:

a hub having a first end and a second end;

a first form mounted to said first end of said hub; and a second form mounted to said second end of said hub;

b) an arm having a first end pivotally mounted to said first form, and a second end configured to removably contact the stack of material, said arm further having a first trigger configured to trigger a height sensor; said height sensor mounted to said stacking apparatus, said height sensor configured to provide a first signal to the central processing unit to lower the collection table when said arm triggers said height sensor;

c) a stop mounted to said first form below said arm, said stop configured to stop pivoting movement of said arm;

d) a torsion device configured to bias said arm toward said stop; and e) a second trigger mounted to said second hub and configured to trigger a validity sensor, said validity sensor mounted to the stacking apparatus, said validity sensor configured to provide a second signal to the central processing unit, said second signal configured to indicate to the central processing unit that the central processing unit may accept said first signal.

13. The mechanism for sensing a position of a top of a stack of material in a stacking apparatus according to claim 12, wherein the stacking apparatus is configured to accept continuous fanfold paper.

14. A method for sensing a position of a top of a stack of material in a stacking apparatus, the apparatus having a collection table and a central processing unit, comprising;

triggering, by a trigger pivotally mounted to a form, a sensor to provide a first signal to the central processing unit, a torsion device being positioned between the trigger and the form the signal instructing the central processing unit to lower the collection table;

providing a second signal to the central processing unit, said second signal indicating to the central processing unit that the central processing unit may accept said first signal.

15. The method for sensing a position of a top of a stack of material in a stacking apparatus according to claim 14, further comprising lowering the collection table.

16. The method for sensing a position of a top of a stack of material in a stacking apparatus according to claim 14, wherein the stacking apparatus accepts continuous fanfold paper.

17. A method for sensing a position of a top of a stack of material in a stacking apparatus, the apparatus having a collection table and a central processing unit, said method comprising:

a) rotating a form fixedly mounted about a rotatable shaft;

b) removably positioning an arm in contact with the stack of material, the arm having a first end pivotally mounted to the form, a second end configured to removably contact the stack of material, a trigger portion, the arm being mounted to the form, with a torsion device positioned between the first end of the arm and the form;

c) triggering a height sensor with the trigger portion of the arm, when the stack of material reaches a predetermined height;

d) providing a first signal to the central processing unit to lower the collection table when the trigger portion of the arm triggers the height sensor; and e) stopping the pivoting motion of the arm.

18. The method for sensing a position of a top of a stack of material in a stacking apparatus according to claim 17, said rotating of a form fixedly mounted about a rotatable shaft comprising rotating a hub assembly about a rotatable shaft, the hub assembly comprising the form and a second form each mounted to a respective end of a hub, the hub assembly having a hollow center portion for fixedly mounting the hub about the rotatable shaft.

19. The method for sensing a position of a top of a stack of material in a stacking apparatus according to claim 17, further comprising triggering a validity sensor by a second trigger, the second trigger mounted to the hub; and providing a second signal to the central processing unit, the second signal indicating to the central processing unit that the central processing unit may accept the first signal.

20. The method for sensing a position of a top of a stack of material in a stacking apparatus according to claim 17, wherein the stacking apparatus accepts continuous fanfold paper.

* * * * *